US012038012B2

(12) United States Patent
Li et al.

(10) Patent No.: US 12,038,012 B2
(45) Date of Patent: Jul. 16, 2024

(54) CENTRIFUGAL PUMP

(71) Applicant: Huawei Digital Power Technologies Co., Ltd., Shenzhen (CN)

(72) Inventors: Jian Li, Xi'an (CN); Shuang Wang, Xi'an (CN); Langlang Li, Dongguan (CN)

(73) Assignee: HUAWEI DIGITAL POWER TECHNOLOGIES CO., LTD., Shenzhen (CN)

( * ) Notice: Subject to any disclaimer, the term of this patent is extended or adjusted under 35 U.S.C. 154(b) by 71 days.

(21) Appl. No.: 17/881,777

(22) Filed: Aug. 5, 2022

(65) Prior Publication Data

US 2023/0049932 A1 Feb. 16, 2023

(30) Foreign Application Priority Data

Aug. 6, 2021 (CN) ..... 202110900977.9

(51) Int. Cl.

| | |
|---|---|
| ***F04D 29/042*** | (2006.01) |
| ***F04D 1/00*** | (2006.01) |
| ***F04D 15/00*** | (2006.01) |
| ***F04D 25/06*** | (2006.01) |
| ***F04D 29/043*** | (2006.01) |

(Continued)

(52) U.S. Cl.

CPC ..... *F04D 29/042* (2013.01); *F04D 1/00* (2013.01); *F04D 15/0005* (2013.01); *F04D 15/0016* (2013.01); *F04D 15/0022* (2013.01); *F04D 25/06* (2013.01); *F04D 29/043* (2013.01); *F04D 29/046* (2013.01); *F04D 29/42* (2013.01); *F04D 29/426* (2013.01)

(58) Field of Classification Search

CPC ..... F04D 29/042; F04D 15/0022; F04D 1/00; F04D 15/0005; F04D 15/0016; F04D 29/42; F04D 25/06; F04D 29/043; F04D 29/046; F04D 29/426

See application file for complete search history.

(56) References Cited

U.S. PATENT DOCUMENTS 3,162,128 A 12/1964 Bertel
3,404,631 A * 10/1968 Nixon ..... F04D 29/042 415/126

(Continued)

FOREIGN PATENT DOCUMENTS

FR 1563183 A 4/1969
GB 1379075 A 1/1975

*Primary Examiner* — Peter J Bertheaud
(74) *Attorney, Agent, or Firm* — WOMBLE BOND DICKINSON (US) LLP

(57) ABSTRACT

Embodiments of this application provide a centrifugal pump. The centrifugal pump includes a pump casing and a first drive mechanism, a second drive mechanism, a pump shaft, and an impeller that are disposed in the pump casing. The pump casing includes a first chamber and a second chamber that are connected. An axis of the pump shaft coincides with axes of the first chamber and the second chamber. An inner diameter of the second chamber is greater than that of the first chamber. The impeller is connected to an end of the pump shaft. The first drive mechanism and the second drive mechanism are connected to the pump shaft and located on a side, away from the impeller, of the pump shaft. The first drive mechanism is configured to drive the pump shaft to rotate.

16 Claims, 3 Drawing Sheets

(51) Int. Cl.
*F04D 29/046* (2006.01)
*F04D 29/42* (2006.01)

(56) References Cited

U.S. PATENT DOCUMENTS

| | | | | |
|---|---|---|---|---|
| 5,346,458 | A * | 9/1994 | Affeld | A61M 60/427 600/16 |
| 6,638,031 | B1 | 10/2003 | Humburg | |
| 2001/0031202 | A1 | 10/2001 | Nowack | |

* cited by examiner

CENTRIFUGAL PUMP

CROSS-REFERENCE TO RELATED APPLICATION

This application claims priority to Chinese Patent Application No. 202110900977.9, filed on Aug. 6, 2021, which is hereby incorporated by reference in its entirety.

TECHNICAL FIELD

This application relates to the field of mechanical engineering pump technologies, and in particular, to a centrifugal pump.

BACKGROUND

A pump is a machine that conveys or pressurizes a fluid. The pump transfers mechanical energy of a prime mover or other external energy to liquid, to increase energy of the liquid. A pump that drives liquid through an impeller to rotate at high speed to transfer mechanical energy to a conveyed liquid is an impeller pump. The impeller pump includes a centrifugal pump. The centrifugal pump conveys liquid by a centrifugal force generated during rotation of an impeller.

In a related technology, the centrifugal pump may include a pump casing, a motor, a pump shaft, and an impeller. The motor drives the pump shaft to rotate the impeller in a working chamber of the pump casing. Liquid may be discharged from the working chamber to a drainage pipe by a centrifugal force generated during rotation of the impeller.

In the centrifugal pump, a small fit clearance between the impeller and the working chamber corresponds to a high head and high performance efficiency. However, the impeller is easily stuck due to, for example, impurity particles stuck in the fit clearance, resulting in poor reliability

SUMMARY

An embodiment of this application provides a centrifugal pump, to meet requirements of high head and high reliability of a pump.

According to a first embodiment, a centrifugal pump includes a pump casing and a first drive mechanism, a second drive mechanism, a pump shaft, and an impeller that are disposed in the pump casing.

The pump casing includes a first chamber and a second chamber that are connected. An axis of the pump shaft coincides with axes of the first chamber and the second chamber. An inner diameter of the second chamber is greater than that of the first chamber. The impeller is connected to an end of the pump shaft. The first drive mechanism and the second drive mechanism are connected to the pump shaft and located on a side, away from the impeller, of the pump shaft. The first drive mechanism is configured to drive the pump shaft to rotate. The second drive mechanism is configured to drive the pump shaft to move along the axis. The impeller is driven by the pump shaft to rotate in the first chamber or the second chamber.

Two chambers with different inner diameters are disposed in the pump casing of the centrifugal pump provided in this embodiment of this application, and drive mechanisms that drive the impeller to move in the two chambers are also disposed in the pump casing. Because of a small clearance between the impeller and an inner wall of the first chamber, the centrifugal pump can give play to characteristics of high flow and high head. After the impeller is stuck by large particle impurities, the drive mechanisms drive the impeller to the second chamber. Because of a large clearance between the impeller and an inner wall of the second chamber, the centrifugal pump has strong impurity resistance and the impeller may be released from a stuck state. High performance and high reliability of the centrifugal pump may be implemented by controlling switching of two operating modes.

In one embodiment, the first drive mechanism includes a first bearing, a motor, and a second bearing that are sequentially connected to the pump shaft. The motor is configured to drive the pump shaft to rotate. The first bearing and the second bearing are sleeved outside the pump shaft. The first bearing is located on the side, away from the impeller, of the pump shaft.

The motor may drive the pump shaft to rotate. The first bearing and the second bearing are configured to support the rotating pump shaft, to reduce a friction coefficient during rotation of the pump shaft, so that rotation precision of the pump shaft is ensured.

In one embodiment, the first drive mechanism further includes a first slide and a second slide. The first slide and the second slide are fixed in the pump casing. The first bearing is connected in the first slide and may slide in a direction of the axis of the pump shaft in the first slide. The second bearing is connected in the second slide and may slide in the direction of the axis of the pump shaft in the second slide.

The first slide is configured to ensure that the first bearing is fixed in the pump casing and moves axially. Similarly, the second slide is configured to ensure that the second bearing is fixed in the pump casing and moves axially. The first slide and the second slide may cooperate with the sliding of the first bearing and the second bearing, to enable the pump shaft to move more smoothly, and the operating modes of the centrifugal pump to be switched more smoothly.

In one embodiment, the second drive mechanism includes a coil, a spring, and an armature. The armature is disposed on a side, facing away from the motor, of the first bearing. The armature is connected to the first bearing through the spring. A direction of contraction of the spring is parallel to or coincides with a direction of the axis of the pump shaft. The armature is connected to the coil. The coil may be energized to turn the armature into a magnetic attraction structure.

The coil may form a magnetic field after being energized. The armature may form a magnetic attraction force and may attract the first bearing, and the spring 32 is compressed, so that the first bearing, the second bearing, the pump shaft, and the impeller move as a whole. Then, the impeller is switched to move in the first chamber or in the second chamber.

In one embodiment, the centrifugal pump further includes an ammeter and a tachometer. The second drive mechanism further includes a controller connected to the coil. The controller is connected to the ammeter or the tachometer. The controller is configured to receive a current signal from the ammeter or a rotational speed signal from the tachometer, and control the coil to be energized or de-energized based on the current signal or the rotational speed signal.

The controller is configured to detect an abnormal current signal or an abnormal rotational speed signal, to control the coil to be energized and de-energized. Therefore, the impeller may be timely released from a stuck state, to improve performance and reliability of the centrifugal pump.

In one embodiment, the second drive mechanism further includes a manual switch. The manual switch is connected to the coil and is configured to control the coil to be energized or de-energized.

The manual switch is configured to control the coil to be energized or de-energized, to facilitate a user to operate. The impeller may be released from the stuck state, to improve performance and reliability of the centrifugal pump.

In one embodiment, the second chamber is located on a side, facing away from the first drive mechanism, of the first chamber.

The second chamber with a large inner diameter is located at the bottom of the pump casing, so that the centrifugal pump has an aesthetic appearance and a low overall center, and the centrifugal pump may be placed stably.

In one embodiment, the centrifugal pump further includes a first branch pipe and a second branch pipe. The first branch pipe is connected to a side wall of the first chamber, and the second branch pipe is connected to a side wall of the second chamber. The first branch pipe and the second branch pipe come together and are connected to a drainage pipe.

The first branch pipe and the second branch pipe are disposed respectively on the side walls of the first chamber and the second chamber, so that liquid can be smoothly discharged in the two operating modes of the centrifugal pump. Therefore, the centrifugal pump has higher drainage efficiency than a centrifugal pump in which only one drainage pipe is disposed.

In one embodiment, a first one-way valve is disposed on the first branch pipe and a second one-way valve is disposed on the second branch pipe.

A one-way valve is disposed on each of the first branch pipe and the second branch pipe, so that liquid is discharged only from the first branch pipe in an operating mode 1 or discharged only from the second branch pipe in an operating mode 2. In this way, liquid in one branch pipe is prevented from flowing back to the other branch pipe, to ensure a drainage effect.

In one embodiment, the centrifugal pump is a vertical pump, and the pump casing and the axis of the pump shaft are vertical with respect to a horizontal plane.

When the vertical centrifugal pump operates, the first chamber and the second chamber are filled with liquid, and the impeller is immersed in the liquid. The first bearing, the motor, and the second bearing may be disposed sequentially from top to bottom, located at an upper part of the pump casing and separated from a liquid surface.

Two chambers with different inner diameters are disposed in the pump casing of the centrifugal pump provided in this embodiment of this application, and the drive mechanisms that drive the impeller to move in the two chambers are also disposed in the pump casing. Because of the small clearance between the impeller and the inner wall of the first chamber, the centrifugal pump can give play to the characteristics of high flow and high head. After the impeller is stuck by large particle impurities, the drive mechanisms drive the impeller to the second chamber. Because of the large clearance between the impeller and the inner wall of the second chamber, the centrifugal pump has strong impurity resistance and the impeller may be released from the stuck state. High performance and high reliability of the centrifugal pump may be implemented by controlling switching of the two operating modes. Further, the armature, the coil, and the spring are ingeniously used to form a magnetic drive mechanism, so that the impeller moves smoothly in a direction of the axis.

Figure 1:
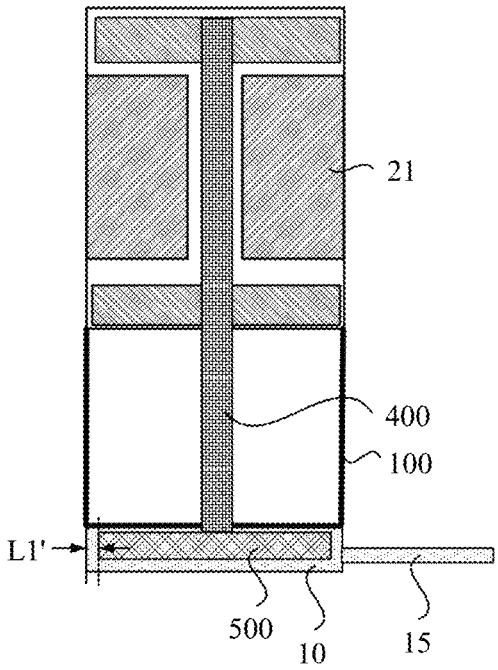
FIG. 1 is a schematic diagram of a structure of a centrifugal pump according to a related technology.

| Description of reference numerals: | | |
|---|---|---|
| 100-pump casing; | 10-working chamber; | 11-first chamber; |
| 12-second chamber; | 13-first branch pipe; | 131-first one-way valve; |
| 14-second branch pipe; | 141-second one-way valve; | 15-drainage pipe; |
| 200-first drive mechanism; | 21-motor; | 22-first bearing; |
| 23-second bearing; | 24-first slide; | 25-second slide; |
| 300-second drive mechanism; | 31-coil; | 32-spring; |
| 33-armature; | 400-pump shaft; and | 500-impeller. |

DESCRIPTION OF EMBODIMENTS

A centrifugal pump conveys liquid by a centrifugal force generated during rotation of an impeller. As a common drainage apparatus, the centrifugal pump may be used in a plurality of fields, such as a drainage process of a cooling system in a data center. The centrifugal pump may usually include a pump casing, a motor, a pump shaft, and an impeller. The motor drives the pump shaft to rotate the impeller in a working chamber of the pump casing. Liquid may be discharged from the working chamber to a drainage pipe by a centrifugal force generated during rotation of the impeller. The centrifugal pump has two important parameters, namely, performance and reliability.

A head is a key characteristic of the performance of the centrifugal pump. The head refers to a height at which water can be pumped up by a water pump, and is an important working performance parameter of the pump. The head is also referred to as a pressure head, and may be expressed as an increase in a pressure energy head, a kinetic energy head and a potential energy head of a fluid. The head of the centrifugal pump includes two parts based on a centerline of the impeller, and is a sum of a suction head and a pressurized head. The suction head is a height at which a water pump can suck water, and indicates a vertical height from a centerline of an impeller of the water pump to a source water surface. The pressurized head is a height at which the pump can pressurize water, and indicates a vertical height from the centerline of the impeller of the water pump to a water surface of an outlet pond.

Impurity resistance is a key characteristic of the reliability of the centrifugal pump. In a drainage process of the centrifugal pump, external impurities such as scale and gravel inevitably exist in water. When these impurities enter the centrifugal pump, the pump shaft or impeller may be stuck, resulting in a failure of the centrifugal pump. Therefore, the centrifugal pump has low reliability.

The head and the impurity resistance of the centrifugal pump are closely related to a size of a clearance between mechanical parts in the centrifugal pump. The head and the reliability of the centrifugal pump are contradictory in mechanism. The centrifugal pump in a related technology can hardly meet requirements of high head and high reliability at the same time.

FIG. 1 is a schematic diagram of a structure of a centrifugal pump provided in a related technology. As shown in FIG. 1, in the related technology, the centrifugal pump may include a pump casing 100, a motor 21, a pump shaft 400, and an impeller 500. The motor 21, the pump shaft 400, and the impeller 500 are disposed in the pump casing 100. The motor 21 is connected to the pump shaft 400. The impeller 500 is connected to an end of the pump shaft 400. A working chamber 10 is disposed at the bottom of the pump casing 100, and a side wall of the working chamber 10 is connected to a drainage pipe 15. The impeller 500 is disposed in the working chamber 10. Driven by the motor 21, the pump shaft 400 drives the impeller 500 to rotate in the working chamber 10, to discharge liquid in the working chamber 10 from the drainage pipe 15.

In the related technology, due to a small clearance between the impeller 500 and the working chamber 10, the centrifugal pump has high work efficiency. Further, the centrifugal pump has a high head under a same volume and power condition. Therefore, the centrifugal pump may meet a use requirement under a high performance condition. However, when the clearance L between the impeller 500 and the working chamber 10 is excessively small and if water contains impurities, the impeller is easily stuck during operation of the centrifugal pump, resulting in a fault in the centrifugal pump.

Figure 2:
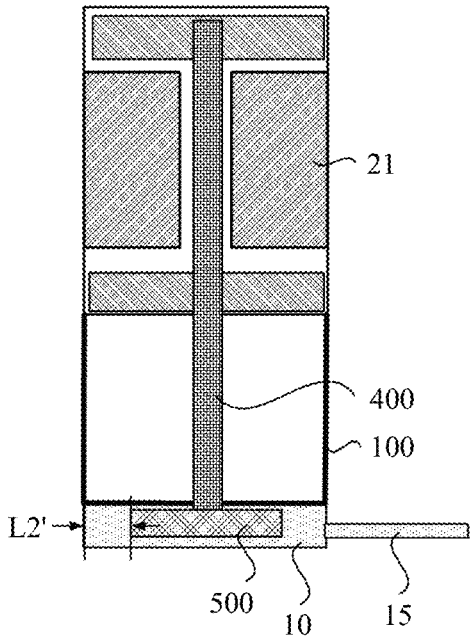
FIG. 2 is a schematic diagram of another structure of a centrifugal pump according to a related technology.

FIG. 2 is a schematic diagram of another structure of a centrifugal pump provided in a related technology. As shown in FIG. 2, in another related technology, the centrifugal pump may include a pump casing 100, a motor 21, a pump shaft 400, and an impeller 500. The centrifugal pump has the same components and component connection relationship as the centrifugal pump provided in FIG. 1. A difference lies in that, in that the pump shown in FIG. 2, due to a large clearance L2' between the impeller 500 and the working chamber 10, it may be ensured that the impeller is not stuck by impurity particles, and related hard particle impurities are discharged from the pump along with water. Therefore, the centrifugal pump has high reliability. However, due to the large clearance, the impeller has low work efficiency and poor head performance. Therefore, performance of the centrifugal pump is degraded when the centrifugal pump has the same volume and power.

As such, when a fit clearance between the impeller and the working chamber is small, the centrifugal pump has a high head and high performance efficiency. However, impurity particles are easily stuck in the clearance, resulting in a failure and poor reliability of the centrifugal pump. Conversely, when the fit clearance between the impeller and the working chamber is large, the head of the centrifugal pump is reduced. However, impurity particles can be easily discharged, so that reliability of the pump is high The centrifugal pump in a related technology can meet only one requirement, and can hardly meet requirements of high head and high impurity resistance at the same time.

In view of the problems, two chambers with different inner diameters are disposed in the pump casing of the centrifugal pump provided in this embodiment of this application, and drive mechanisms that drive the impeller to move in the two chambers are also disposed in the pump casing. Because of a small clearance between the impeller and the inner wall of the first chamber, the centrifugal pump can give play to the characteristics of high flow and high head. After the impeller is stuck by large particle impurities, the drive mechanisms drive the impeller to the second chamber. The centrifugal pump has strong impurity resistance and the impeller returns to normal rotation. Therefore, high performance and high reliability of the centrifugal pump may be implemented.

Figure 3:
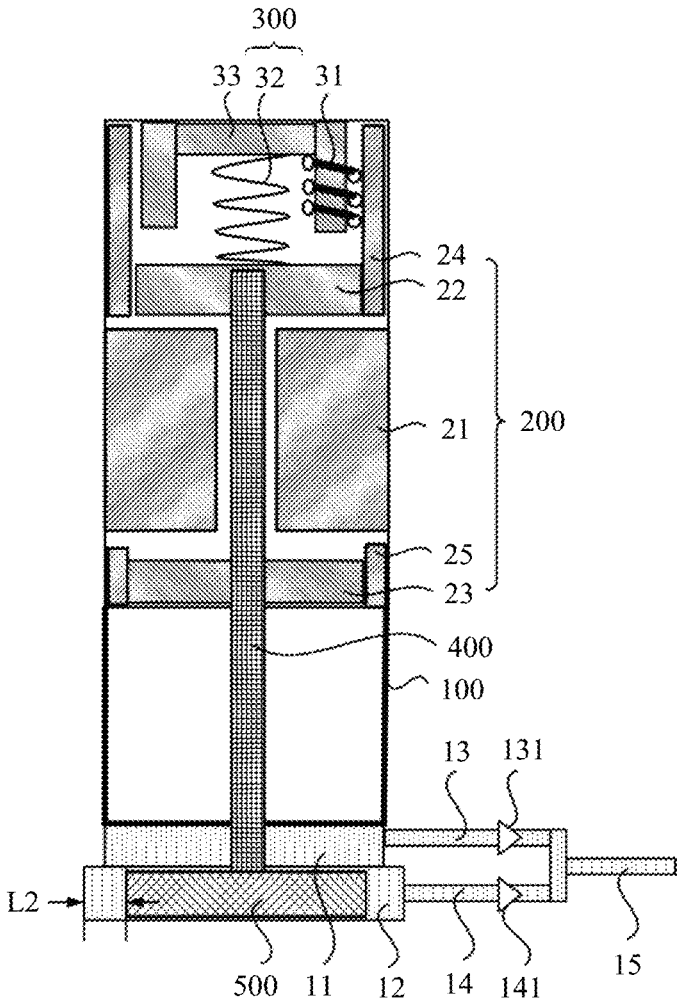
FIG. 3 is a schematic diagram of a structure of a centrifugal pump according to one embodiment.
Figure 4:
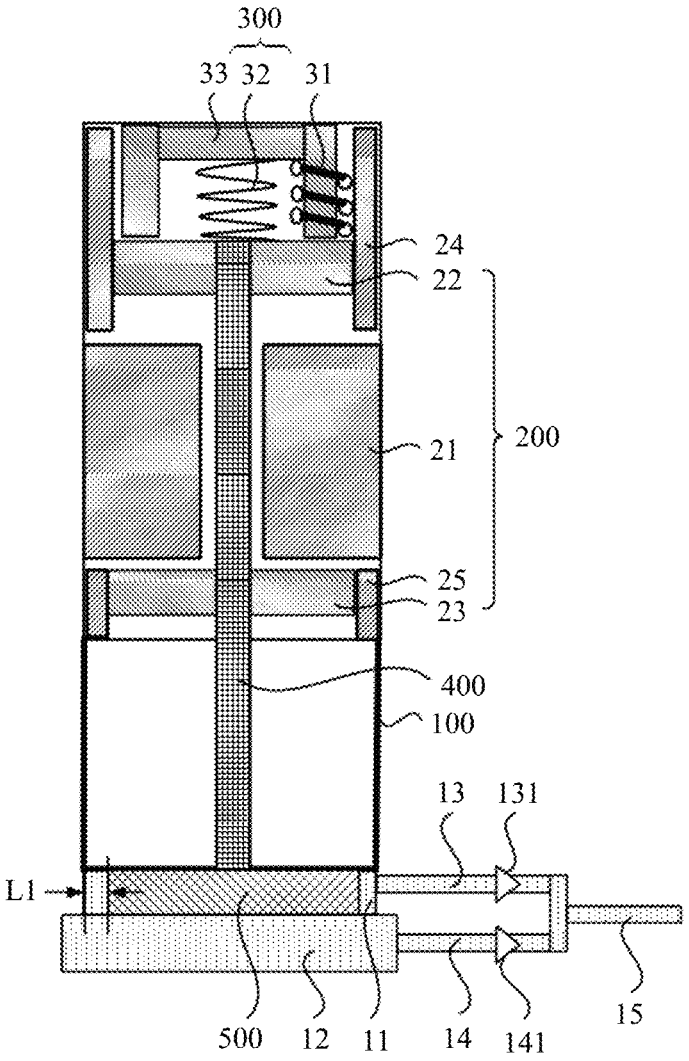
FIG. 4 is a schematic diagram of a structure of a centrifugal pump in another state according to one embodiment.

FIG. 3 is a schematic diagram of a structure of a centrifugal pump provided in an embodiment of this application. FIG. 4 is a schematic diagram of a structure of the centrifugal pump in another state provided in this embodiment of this application. As shown in FIG. 3 and FIG. 4, the centrifugal pump provided in this embodiment of this application may include a pump casing 100 and a first drive mechanism 200, a second drive mechanism 300, a pump shaft 400, and an impeller 500 that are disposed in the pump casing 100.

The pump casing 100 may include a first chamber 11 and a second chamber 12 that are connected. An axis of the pump shaft 400 coincides with axes of the first chamber 11 and the second chamber 12. An inner diameter of the second chamber 12 is greater than that of the first chamber 11. The impeller 500 is connected to an end of the pump shaft 400. The impeller 500 may rotate in the first chamber 11 or the second chamber 12.

The centrifugal pump provided in this embodiment of this application may have two operating modes. Operating mode 1: The impeller 500 is located in the first chamber 11, and because of a small clearance L1 between the impeller 500 and an inner wall of the first chamber 11, the centrifugal pump can give play to characteristics of high flow and high head. Operating mode 2: The impeller 500 is located in the second chamber 12, and because of a large clearance L2 between the impeller 500 and an inner wall of the second chamber, the centrifugal pump has strong impurity resistance and the impeller 500 is not easily stuck. The impeller 500 is controlled to move in the first chamber 11 or the second chamber 12 in different scenarios, so that high performance and high reliability of the centrifugal pump may be implemented.

In this embodiment of this application, the first drive mechanism 200 is configured to reliably rotate the impeller 500. The first drive mechanism 200 is connected to the pump shaft 400, and is located on a side, away from the impeller 500, of the pump shaft 400. The first drive mechanism 200 is configured to drive the pump shaft 400 to rotate, so that the pump shaft 400 drives the impeller 500 to rotate.

The first drive mechanism 200 may include a motor 21. The motor 21 is connected to the pump shaft 400 and may drive the pump shaft 400 to rotate. The first drive mechanism 200 may further include a first bearing 22 and a second bearing 23. The first bearing 22, the motor 21, and the second bearing 23, are sequentially connected to the pump shaft 400. The first bearing 22 and the second bearing 23 are sleeved outside the pump shaft 400. The first bearing 22 is located on the side, away from the impeller 500, of the pump shaft 400. The first bearing 22 and the second bearing 23 are configured to support the rotating pump shaft 400, to reduce a friction coefficient during rotation of the pump shaft 400, so that rotation precision of the pump shaft 400 is ensured.

It should be noted that the centrifugal pump may be a vertical pump. In one embodiment, the pump casing 100 and the axis of the pump shaft 400 are vertical with respect to a horizontal plane. In this case, the first chamber 11 and the second chamber 12 are located at the bottom of the pump casing 100. When the centrifugal pump operates, the first chamber 11 and the second chamber 12 are filled with liquid, and the impeller 500 is immersed in the liquid. The first bearing 22, the motor 21, and the second bearing 23 may be disposed sequentially from top to bottom, located at an upper part of the pump casing 100, and separated from a liquid surface.

In addition, in this embodiment of this application, the second drive mechanism 300 is configured to move the impeller 500 along the axis. The second drive mechanism 300 is connected to the pump shaft 400, and is located on the side, away from the impeller 500, of the pump shaft 400. The second drive mechanism 300 is configured to drive the pump shaft 400 to move along the axis, so that the impeller 500, when driven by the pump shaft 400, may be switched to move in the first chamber 11 or the second chamber 12.

It should be understood that both the first bearing 22 and the second bearing 23 may be sliding bearings or rolling bearings. The first bearing 22, the second bearing 23, and the pump shaft 400 are connected into a whole, and the impeller 500 is fixedly connected to the end of the pump shaft 400, so that the first bearing 22, the second bearing 23, the pump shaft 400, and the impeller 500 are connected into a whole being mounted. A relative position of each component is fixed in space. The second drive mechanism 300 may drive the pump shaft 400 or the first bearing 22 to move, so that the impeller 500 is driven to move in a direction of the axis.

The second drive mechanism 300 may include a coil 31, a spring 32, and an armature 33. The armature 33 is disposed on a side, facing away from the motor 21, of the first bearing 22, that is, the armature is disposed at the top of the pump casing 100. The armature 33 is connected to the first bearing 22 through the spring 32. A direction of contraction of the spring 32 is parallel to or coincides with a direction of the axis of the pump shaft 400. The armature 33 is connected to the coil 31, and the coil 31 may be energized to turn the armature 33 into a magnetic attraction structure.

The coil 31 may form a magnetic field after being energized. The armature 33 may form a magnetic attraction force and may attract the first bearing 22 to compress the spring 32, so that the first bearing 22, the second bearing 23, the pump shaft 400, and the impeller 500 move as a whole, and then the impeller 500 is switched to move in the first chamber 11 or the second chamber 12.

It should be understood that relative positions of the first chamber 11 and the second chamber 12 in the pump casing 100 are not limited in this embodiment. For example, the second chamber 12 may be located on a side, away from the first drive mechanism 200, of the first chamber 11. In one embodiment, as shown in the figure, the second chamber 12 may be located below the first chamber 11.

In this way, in an initial state in which the coil 31 is not energized, the armature 33 has no magnetic attraction force, and the spring 32 may be in an expanded state and press the first bearing 22, so that the impeller 500 may be located in the second chamber 12. After the coil 31 is energized, the armature 33 may attract the first bearing 22 to move upward, and the pump shaft 400 and the impeller 500 synchronously move upward, so that the impeller 500 is located in the first chamber 11.

During switching of the two operating modes, the first bearing 22 and the second bearing 23 each may have a circumferential fixing function. Further, the first bearing 22 may have a thrust function, so that the pump shaft 400 may have an axial positioning function.

In addition, the first drive mechanism 200 further includes a first slide 24 and a second slide 25. The first slide 24 and the second slide 25 are fixed in the pump casing 100. The first bearing 22 is connected in the first slide 24 and may slide in a direction of the axis of the pump shaft 400 in the first slide 24. The second bearing 23 is connected in the second slide 25 and may slide in the direction of the axis of the pump shaft 400 in the second slide 25.

The first slide 24 is configured to ensure that the first bearing 22 is fixed in the pump casing 100 and moves axially. Similarly, the second slide 25 is configured to ensure that the second bearing 23 is fixed in the pump casing 100 and moves axially. In this way, when the coil 31 is energized or de-energized, based on an attraction force of the armature 33 or a pressure of the spring 32, the first slide 24 and the second slide 25 may cooperate with sliding of the first bearing 22 and the second bearing 23, to enable the pump shaft 400 to move more smoothly, and the operating modes of the centrifugal pump to be switched more smoothly.

In the two operating modes of the centrifugal pump provided in this embodiment of this application, the coil 31 may be triggered to be energized or de-energized in different ways to implementing switching of the modes.

In one embodiment, a triggering mode is automatic triggering. In one embodiment, the centrifugal pump further includes an ammeter and a tachometer. The second drive mechanism 300 may further include a controller connected to the coil 31. The controller is connected to the ammeter or the tachometer. The controller is configured to receive a current signal from the ammeter or a rotational speed signal from the tachometer, and control the coil 31 to be energized or de-energized based on the current signal or the rotational speed signal.

The ammeter in the centrifugal pump is configured to detect an operating current of the pump when the pump operates. In a state in which the impeller 500 is stuck by large particle impurities, the current increases compared with that in a normal state. The tachometer in the centrifugal pump is configured to detect a rotational speed of the motor 21 or the pump shaft 400. The rotational speed decreases or changes to zero in a state in which the impeller 500 is stuck by large particle impurities.

When the centrifugal pump is in the operating mode 1, that is, when the impeller 500 is located in the first chamber 11, the coil 31 is in an energized state. If the centrifugal pump operates normally, the controller may detect that a current signal or a rotational speed signal is normal. When the controller detects an increase in a current or a decrease in a rotational speed, it is determined that the impeller 500 may be stuck. Then, the controller may control the coil 31 to be de-energized. Under the action of the spring 32, the impeller 500 moves downward into the second chamber 12, and the centrifugal pump is switched to the operating mode 2. Because the clearance between the impeller 500 and an inner wall of the chamber is increased, the impeller 500 is released from a stuck state. After the centrifugal pump operates for a period of time in the operating mode 2, the controller may control the coil 31 to be energized, and then the centrifugal pump returns to the operating mode 1 again, to ensure that the centrifugal pump gives play to the characteristics of high flow and high head.

The controller is configured to detect an abnormal current signal or an abnormal rotational speed signal, to control the coil 31 to be energized or de-energized. Therefore, the impeller 500 may be timely released from a stuck state, to improve performance and reliability of the centrifugal pump.

In one embodiment, the triggering mode is manual triggering. The second drive mechanism 300 further includes a manual switch that is connected to the coil 31, and is configured to control the coil 31 to be energized or de-energized. The manual switch may be disposed outside the pump casing 100 of the centrifugal pump to facilitate manual operation by a user. When finding that the impeller 500 is stuck and the centrifugal pump operates abnormally, the user operates the manual switch to control the coil 31 to be de-energized, so that the centrifugal pump is switched from the operating mode 1 to the operating mode 2. After the impeller is released from the stuck state, the manual switch is operated again, and the coil 31 may be controlled to be energized, so that the centrifugal pump is switched from the operating mode 2 to the operating mode 1.

An operating process of the centrifugal pump provided in this embodiment of this application is as follows: To ensure performance of the centrifugal pump, the coil 31 is controlled to be in an energized state, so that the impeller 500 is located in the first chamber 11 and the centrifugal pump operates in the operating mode 1. When the impeller 500 is stuck, the coil 31 is manually or automatically triggered to be de-energized, so that the impeller 500 is located in the second chamber 12 and the centrifugal pump operates in the operating mode 2. After the centrifugal pump operates for a period of time, the coil 31 may be triggered to be energized again, so that the impeller 500 is located in the first chamber 11 and the centrifugal pump operates in the operating mode 1.

Based on the foregoing embodiment of this application, in this embodiment of this application, the centrifugal pump further includes a first branch pipe 13 and a second branch pipe 14. The first branch pipe 13 is connected to a side wall of the first chamber 11. The second branch pipe 14 is connected to a side wall of the second chamber 12. The first branch pipe 13 and the second branch pipe 14 come together and are connected to the drainage pipe 15.

When the impeller 500 rotates in the first chamber 11, liquid in the first chamber 11 may enter the first branch pipe 13 under the action of a centrifugal force and then is discharged through the drainage pipe 15. When the impeller 500 rotates in the second chamber 12, liquid in the second chamber 12 may enter the second branch pipe 14 under the action of a centrifugal force and then is discharged through the drainage pipe 15.

The first branch pipe 13 and the second branch pipe 14 are disposed respectively on the side walls of the first chamber 11 and the second chamber 12, so that liquid can be smoothly discharged in the two operating modes. Therefore, the centrifugal pump has higher drainage efficiency than a centrifugal pump in which only one drainage pipe is disposed.

Further, a first one-way valve 131 may be disposed on the first branch pipe 13 and a second one-way valve 141 may be disposed on the second branch pipe 14. After the first one-way valve 131 is opened, liquid may flow only from the first chamber 11 to the drainage pipe 15. After the second one-way valve 141 is opened, liquid may flow only from the second chamber 12 to the drainage pipe 15.

When the impeller 500 rotates in the first chamber 11, the first one-way valve 131 is opened and the second one-way valve 141 is closed. Therefore, the liquid in the first chamber 11 may enter the first branch pipe 13 under the action of a centrifugal force and then is discharged through the drainage pipe 15. When the impeller 500 rotates in the second chamber 12, the first one-way valve 131 is closed and the second one-way valve 141 is opened. Therefore, the liquid in the second chamber 12 may enter the second branch pipe 14 under the action of a centrifugal force and then is discharged through the drainage pipe 15.

A one-way valve is disposed on each of the first branch pipe 13 and the second branch pipe 14, so that liquid is discharged only from the first branch pipe 13 in the operating mode 1 or discharged only from the second branch pipe 14 in the operating mode 2. In this way, liquid in one branch pipe is prevented from flowing back to the other branch pipe, to ensure a drainage effect.

In the centrifugal pump provided in this embodiment of this application, two chambers with different inner diameters are disposed in the pump casing, and drive mechanisms that drive the impeller to move in the two chambers are also disposed in the pump casing. Because of the small clearance between the impeller and an inner wall of the first chamber, the centrifugal pump can give play to the characteristics of high flow and high head. After the impeller is stuck by large particle impurities, the drive mechanisms drive the impeller to the second chamber. Because of the large clearance between the impeller and an inner wall of the second chamber, the centrifugal pump has strong impurity resistance and the impeller may be released from the stuck state. High performance and high reliability of the centrifugal pump may be implemented by controlling switching of two operating modes. Further, the armature, the coil, and the spring are ingeniously used to form a magnetic drive mechanism, so that the impeller moves smoothly in a direction of the axis.

Finally, it should be noted that the foregoing embodiments are merely intended for describing the technical solutions of the embodiments of this application rather than limiting this application. Although the embodiments of this application are described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of this application.

What is claimed is:

1. A centrifugal pump, comprising a pump casing and a first drive mechanism, a second drive mechanism, a pump shaft, and an impeller that are disposed in the pump casing, wherein the pump casing comprises a first chamber and a second chamber that are connected, a first axis of the pump shaft coincides with respective axes of the first chamber and the second chamber, an inner diameter of the second chamber is greater than an inner diameter of the first chamber, the impeller is connected to an end of the pump shaft, the first drive mechanism and the second drive mechanism are connected to the pump shaft and located on a side of the pump shaft that is opposite the impeller, the first drive mechanism is configured to drive the pump shaft to rotate, the second drive mechanism is configured to drive the pump shaft to move along the first axis, and the impeller is driven by the pump shaft to rotate in the first chamber or the second chamber;

wherein the first drive mechanism comprises a first bearing that is connected to the pump shaft, the first bearing is located on the side of the pump shaft that is opposite the impeller; and the second drive mechanism comprises a coil, a spring, and an armature, the armature is located on a side opposite from a motor of the first bearing, the armature is connected to the first bearing through the spring, a direction of contraction of the spring corresponding to a direction of the first axis of the pump shaft, the armature is connected to the coil, and the coil is energized to turn the armature into a magnetic attraction structure.

2. The centrifugal pump according to claim 1, wherein the first drive mechanism further comprises the motor, and a second bearing, the first bearing, the motor, and the second bearing are sequentially connected to the pump shaft, the motor is configured to drive the pump shaft to rotate, the first bearing and the second bearing are sleeved external to the pump shaft.

3. The centrifugal pump according to claim 2, wherein the first drive mechanism further comprises a first slide and a second slide, the first slide and the second slide are fixed in the pump casing, the first bearing is connected in the first slide and slides in a direction of the first axis of the pump shaft in the first slide, and the second bearing is connected in the second slide and slides in the direction of the first axis of the pump shaft in the second slide.

4. The centrifugal pump according to claim 1, further comprising a meter, the second drive mechanism further comprises a controller connected to the coil, the controller is connected to the meter, the controller is configured to receive a signal from the meter, and control the coil to be energized or de-energized based on the signal.

5. The centrifugal pump according to claim 1, wherein the second drive mechanism further comprises a manual switch connected to the coil and configured to control the coil to be energized or de-energized.

6. The centrifugal pump according to of claim 1, wherein the second chamber is located on a side of the first chamber opposite from the first drive mechanism.

7. The centrifugal pump according to claim 2, wherein the second chamber is located on a side of the first chamber opposite from the first drive mechanism.

8. The centrifugal pump according to claim 3, wherein the second chamber is located on a side of the first chamber opposite from the first drive mechanism.

9. The centrifugal pump according to claim 4, wherein the second chamber is located on a side of the first chamber opposite from the first drive mechanism.

10. The centrifugal pump according to claim 1, further comprising a first branch pipe and a second branch pipe, the first branch pipe is connected to a side wall of the first chamber, the second branch pipe is connected to a side wall of the second chamber, and the first branch pipe and the second branch pipe are connected to a drainage pipe.

11. The centrifugal pump according to claim 2, further comprising a first branch pipe and a second branch pipe, the first branch pipe is connected to a side wall of the first chamber, the second branch pipe is connected to a side wall of the second chamber, and the first branch pipe and the second branch pipe are connected to a drainage pipe.

12. The centrifugal pump according to claim 3, further comprising a first branch pipe and a second branch pipe, the first branch pipe is connected to a side wall of the first chamber, the second branch pipe is connected to a side wall of the second chamber, and the first branch pipe and the second branch pipe are connected to a drainage pipe.

13. The centrifugal pump according to claim 4, further comprising a first branch pipe and a second branch pipe, the first branch pipe is connected to a side wall of the first chamber, the second branch pipe is connected to a side wall of the second chamber, and the first branch pipe and the second branch pipe are connected to a drainage pipe.

14. The centrifugal pump according to claim 10, wherein the first branch pipe comprises a first one-way valve and the second branch pipe comprises a second one-way valve.

15. The centrifugal pump according to claim 1, wherein the centrifugal pump is a vertical pump, and the pump casing and the first axis of the pump shaft are vertical with respect to a horizontal plane.

16. The centrifugal pump according to claim 2, wherein the centrifugal pump is a vertical pump, and the pump casing and the first axis of the pump shaft are vertical with respect to a horizontal plane.

* * * * *